US006784404B2

(12) United States Patent
Meyer et al.

(10) Patent No.: US 6,784,404 B2
(45) Date of Patent: Aug. 31, 2004

(54) SYSTEM FOR CONTROLLING THE DURATION OF A SELF-CLEAN CYCLE IN AN OVEN

(75) Inventors: Robert William Meyer, Coloma, MI (US); Paul Karl Krueger, Clayton, OH (US); Erin M. May, Miamisburg, OH (US); Richard L. Baker, Lewisburg, OH (US); Steven T. Baas, Hamilton, OH (US); Anthony T. Jenkins, Lompoc, CA (US); M. Reza Ghassemzadeh, Louisville, KY (US); Matthew T. Wizeman, Fairfax, VA (US)

(73) Assignee: Whirlpool Corporation, Benton Harbor, MI (US)

( * ) Notice: Subject to any disclaimer, the term of this patent is extended or adjusted under 35 U.S.C. 154(b) by 290 days.

(21) Appl. No.: 09/900,933

(22) Filed: Jul. 9, 2001

(65) Prior Publication Data

US 2002/0005401 A1 Jan. 17, 2002

Related U.S. Application Data

(60) Provisional application No. 60/217,557, filed on Jul. 12, 2000.

(51) Int. Cl.[7] ..... F27D 11/00; A21B 1/00

(52) U.S. Cl. ..... 219/412; 219/391

(58) Field of Search ..... 219/391, 412, 219/413, 490, 491, 492, 497, 506, 507, 509, 510; 126/39 R, 39 BA, 39 C, 39 G

(56) References Cited

U.S. PATENT DOCUMENTS

| | | | | |
|---|---|---|---|---|
| 3,962,561 A | | 6/1976 | Maitenaz | 219/391 |
| 4,238,670 A | | 12/1980 | Maitenaz | 219/413 |
| 4,481,404 A | | 11/1984 | Thomas et al. | 219/398 |
| 4,831,237 A | | 5/1989 | Gelineau | 219/398 |
| 4,954,694 A | | 9/1990 | Nagai et al. | 219/413 |
| 5,286,943 A | | 2/1994 | Has | 219/413 |
| 5,343,020 A | | 8/1994 | Waigand et al. | 219/413 |
| 5,438,180 A | * | 8/1995 | Eisenbrandt et al. | 219/492 |
| 5,856,780 A | * | 1/1999 | McGeehin | 340/540 |
| 5,879,631 A | * | 3/1999 | Wewers et al. | 422/98 |

FOREIGN PATENT DOCUMENTS

| | | | |
|---|---|---|---|
| DE | 19606571 | 8/1997 | H05B/1/02 |
| EP | 0380733 | 8/1990 | F24C/7/00 |

* cited by examiner

*Primary Examiner*—Sang Y. Paik
(74) *Attorney, Agent, or Firm*—John F. Colligan; Stephen Krefman; Robert O. Rice

(57) ABSTRACT

A method and apparatus is provided for operating a self-cleaning oven in which a gas sensor, such as for measuring concentrations of CO gas, is located remote from, yet in gas communication with, an exhaust flue of the oven. The gas sensor is located at the end of an outlet tube which extends from the exhaust flue. A sample gas flow is provided to the gas sensor through the outlet tube to isolate the sensor from the heat of the oven and a filter device is located in the outlet tube for filtering the sample gas flow. A valve may be provided at the inlet to the outlet tube. The rate of change (slope) of successive readings of gas concentrations may be used to determine when the combustion of food material is complete, in order to terminate a self-cleaning cycle. As a back up method to the gas sampling system, a count of lengths or numbers of baking cycles and broiling cycles performed since a last self-cleaning cycle can be kept, and a look up table consulted to determine a length of time required for a cleaning cycle. A display is provided to advise the user that a cleaning mode is in operation and to inform the user of the amount of time remaining in the cleaning cycle.

30 Claims, 10 Drawing Sheets

SYSTEM FOR CONTROLLING THE DURATION OF A SELF-CLEAN CYCLE IN AN OVEN

BACKGROUND OF THE INVENTION

The present invention relates to self-cleaning ovens and in particular, to a system for controlling the operation of a self-cleaning oven.

During the use of an oven of an electric or gas range, deposits will generally accumulate as a result of spills, boil overs and other unintended release of foods from their cooking containers. In order to ease the cleaning of the spillage, provision is made in some ranges, known as "self-cleaning" ranges, to raise the temperature of the cooking cavity well above that which would be used in cooking in order to carbonize or burn out the residue. In general, this is achieved by the selection through the range's controls of a self-clean cycle. Initiation of this cycle typically sets a high control temperature for the range, locks the oven door at some predetermined time or temperature and proceeds to heat the cavity to a relatively high temperature for a predetermined time before ending the cycle, allowing cooling to occur and then releasing the door lock as an end to the cycle.

Typically, the time period set for this self-clean cycle is determined by the assumption of a worst case cycle. During the cycle, odors or even smoke may be released in the range environment and significant energy is used to hold the cooking cavity at a high temperature. Because of odor and smoke release, users are advised to open windows and will frequently leave the kitchen area for an extended period of time while self-clean is performed.

If a method can be devised which adjusts the time of self-cleaning to that needed for the existing degree of soil accumulation, then cycle times and their negative impact on kitchen enviromnent and energy usage can be minimized.

U.S. Pat. No. 4,954,694 discloses a self-cleaning oven which incorporates a heat controlled unit which is responsive to a gas signal from a gas sensor located in the exhaust passage. The gas sensor measures humidity or carbon dioxide levels. The heat control samples the gas signal at a given time interval to detect a variation of amount of the gas component and detect a first inflection point from decreasing to increasing or visa versa in a gas-component variation and a second inflection point from decreasing to increasing or vice versa in the gas component variation after detection of the first inflection point. The heat control means determines the heating time period for cleaning in correspondence with the second inflection point. An oxidizing catalyst is provided in the exhaust passage, upstream of the gas sensor.

SUMMARY OF THE INVENTION

It is generally recognized that the combustion of food product will generate various gases or gas components. This invention is generally directed to controlling the operation of a self cleaning oven wherein the duration of a self clean cycle wherein foods are combusted is controlled by monitoring the "signature" response of gas components resulting from the combustion of food soils in an oven cavity. More particularly, the time period of the self clean cycle is responsive to the amount of soil accumulation in the oven.

The present invention controls the duration of a self-clean cycle by monitoring a gas component produced by food combustion and by determining a rate of change between successive gas component signals. Termination of the self clean cycle is initiated once the determined rate of change is maintained below a minimum preset rate of change value for a predetermined length of time. The self clean cycle may be terminated, for example, a predetermined time after the rate of change is maintained below a minimum preset rate of change value for a predetermined length of time. In one embodiment, the measured gas component may be carbon monoxide.

The present invention includes a gas sensor or sensor mechanism to detect gas concentrations found in the exhaust gas during a self cleaning operation. The gas sensor is located remote from the oven and remote from the flue passage, but in communication therewith through a flue gas delivery system. This system comprises a relatively small diameter outlet tube or tubing which branches off from the main flue gas passage and which delivers flue gases to the sensor mechanism. A valve may be optionally provided on the inlet to the small diameter tubing to limit the gas sensor's exposure to flue gases.

In order for the user of the range to be made aware of the status of the self-cleaning cycle, a display may be provided. During the initial evaluation period, while the control is determining the extent of cleaning required, an icon, such as an hour glass, can be displayed on an electronic display located on the range console to symbolize that the clean cycle is in process. Once the self-cleaning duration is determined by the control system, a count down timer can be displayed in lieu of the icon, indicating to the user the time remaining for the completion of the cleaning cycle.

In a further embodiment, the present invention may include an alternate method for determining the amount of clean time needed to perform the self-cleaning cycle wherein the number or length of bake and broil cycles the user has performed since the last self-clean cycle is counted. The number of days since a self-clean cycle has been run is also counted. A minimum clean base time based on these factors could then be determined. Thus, when the user selects and starts a clean cycle, the number or length of bake and broil cycles and the number of days the oven has not been cleaned, are retrieved and used to determine the appropriate clean time. The calculated clean time is displayed to the user to show the length of the clean cycle. This method could be used in lieu of using a gas sensor, or as a back up method in the event of sensor malfunction.

DETAILED DESCRIPTION OF THE PREFERRED EMBODIMENTS

Figure 1:
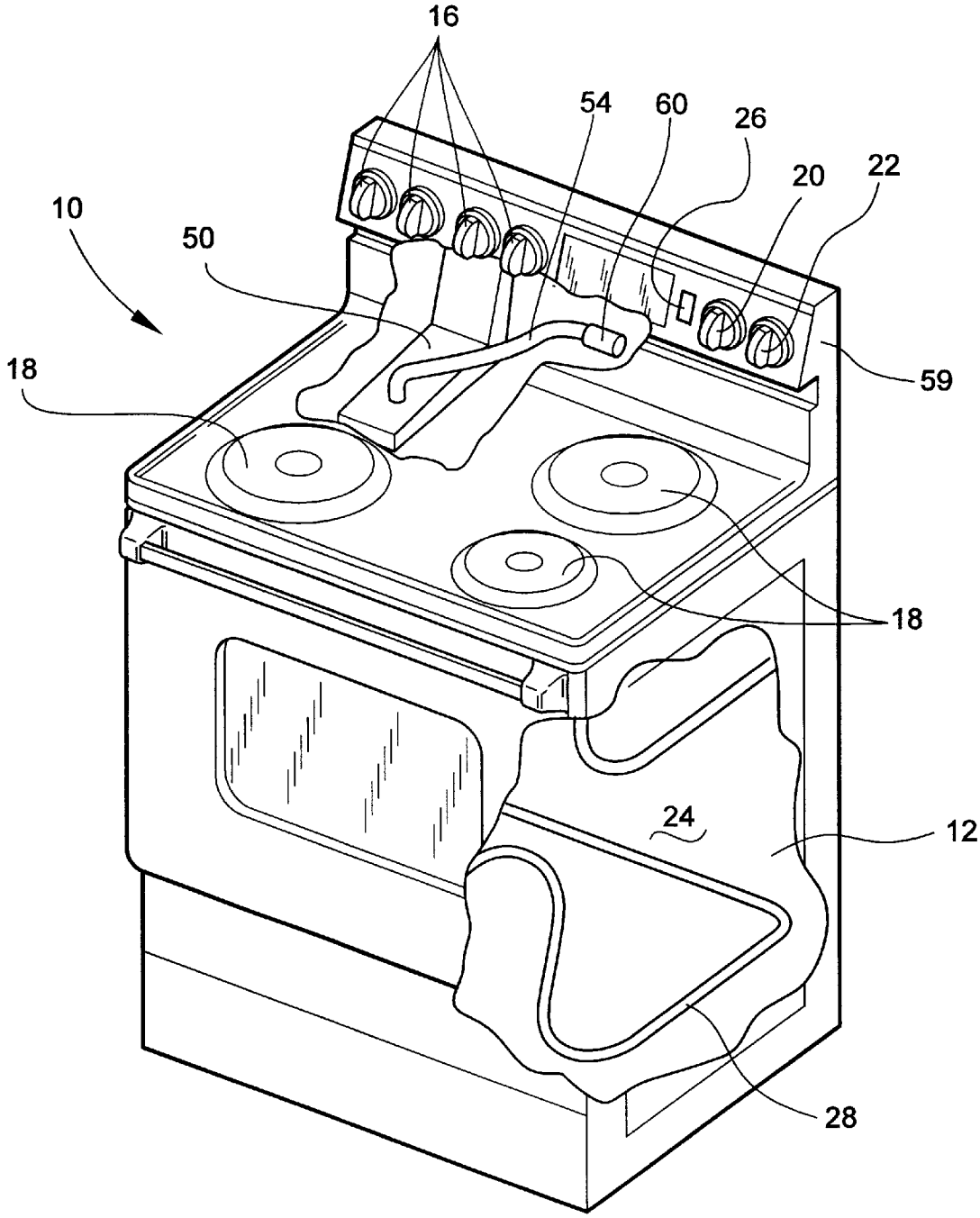
FIG. 1 is a perspective view of an oven embodying the principles of the present invention.
Figure 2:
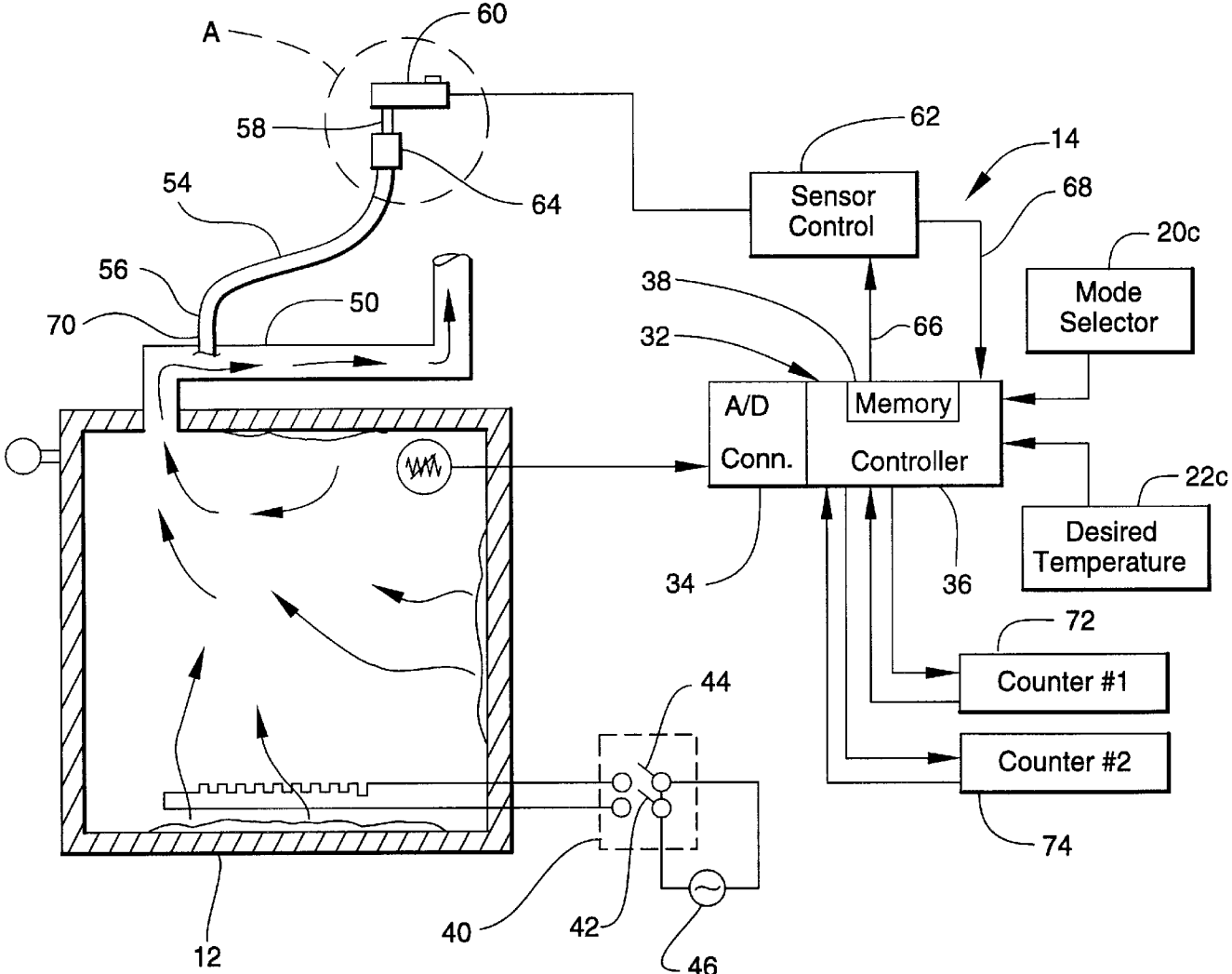
FIG. 2 is a schematic side section of an oven incorporating the principles of the present invention.

FIGS. 1 and 2 illustrate an electric range 10 having a self-cleaning oven 12 adapted to be controlled by a microprocessor based control system 14 and a method in accordance with the principles of the present invention. Although an electric range 10 is illustrated, it should be understood that a gas range may implement the features of the present invention.

The range 10 includes a plurality of control knobs 16 for controlling a respective plurality of conventional electric (or gas) burners 18. In addition, the range 10 includes a control knob 20 for controlling a mode of operation of the oven 12. For example, an OFF mode, a bake mode, a broil mode and a clean mode of operation may be selected by the control knob 20 (as indicated at 20C in FIG. 2). In addition, a control knob 22 is conventionally provided to select a desired oven temperature within the oven 12 (as indicated at 22C in FIG. 2). A timer knob may optionally be provided in the event that the control permits a user override to individually control the length of time for a cleaning process. Disposed within a cavity 24 of the oven 12 are a conventional broiling element 26 and a conventional heating element 28. Furthermore, positioned within the cavity 24 of the oven 12 is a conventional temperature sensor 30, such as, for example, a standard oven temperature sensing probe.

The microprocessor based control system 14 includes a microprocessor 32 suitably programmed to effect the desired control of the range 10. Conventionally, the microprocessor 32 includes an analog-to-digital (a/d) converter 34 for receiving analog voltage input signals from, for example, the temperature sensor 30, and for providing digital output pulses or signals to a controller section 36 within the microprocessor 32. Also, conventionally, the microprocessor 32 includes a memory 38 for retaining programmed instructions for operating the control system 14 including a desired oven temperature control algorithm for controlling the temperature of the oven 12, particularly during the clean mode of operation.

The control system 14 also includes a power switching relay 40 having a pair of relay contacts 42 and 44 for switching power to a heating element, for example, the baking element 28, from a constant voltage (e.g. 240 volts) source 46 of alternating current electric power under the control of the controller 36. For simplification, only the baking element 28 and the power relay 40 therefore have been illustrated in FIG. 2 in the control system 14. In an actual commercial embodiment, however, the broiling element 26 could, of course, be a part of the control system 14 along with its own power switching relay to interconnect the broiling element 26 to the source 46. The broiling element 26 is used in conjunction with a heating element 28 during the broil mode of operation of the oven 12 and may further be used during the bake and clean modes of the oven 12 to provide sufficient heat to the oven 12 under the control of the controller 36.

Above the oven cavity 24 is an exhausting passage or flue passage 50 through which atmosphere within the oven cavity 24 may be exhausted to the ambient atmosphere. In a preferred, although not necessary, arrangement, an outlet tube 54 is provided which communicates at a first inlet end 56 with the flue passage 50 and has a second end 58 which preferably is located in or near a console 59 of the stove on which the various control knobs 16, 20, 22 are mounted. A gas sensor 60 is connected to the second end 58 of the outlet tube 54. With the sensor located in or near the console 59 the sensor will be isolated from the high temperatures of the oven cavity 24.

The sensor 60 may be an infrared (IR) type gas sensor wherein infrared light is emitted from an infrared source and directed through a sample chamber to an infrared detector. The sensor 60 is interconnected with a sensor controller 62 for providing readings of selected gas concentration levels. The sensor controller 62, along with the other control components may also be located within the console 59. It can be understood by one skilled in the art that the sensor 60 may be mounted directly to a circuit board which also supports the sensor control 62. In a preferred arrangement, there is the main controller 32 and a separate sensor control 62—each being separately mounted printed circuit boards (PCBs). However, the main controller 32 and the sensor controller 62 may also be combined into single controller or mounted on a single PCB. The control system for the range 12 may be generally referred to as the control system 14—including both the controller 32 and the sensor controller 62.

Although the shape and arrangement of the outlet tube 54 can be varied, in a preferred arrangement the outlet tube 54 includes a portion that has a continuous upward slope from its inlet end 56 to its outlet end 58 such that any condensation from gases flowing therein will drip back into the flue passage 50 and will not collect in the outlet tube 54 which might otherwise block the tube 54.

A gate valve 70 may be provided at the inlet 56 to the outlet tube 54 for controlling the flow of exhaust gas into the outlet tube 54. The gate valve 70 may be formed of a bi-metal plate provided at the inlet 56 to the tubing 54 where it branches off from the flue passage 50. The bi-metal operating temperature is designed for a high activation temperature such that only during the self-clean mode will the bi-metal plate open, permitting flue gases to flow through the tubing 54 to the sensor 60. The bi-metal plate would remain shut at lower temperatures, such as during baking or broiling. In this manner, exposure of the sensor 60 to flue gases is significantly reduced, which in turn prolongs sensor life and performance.

Figure 3:
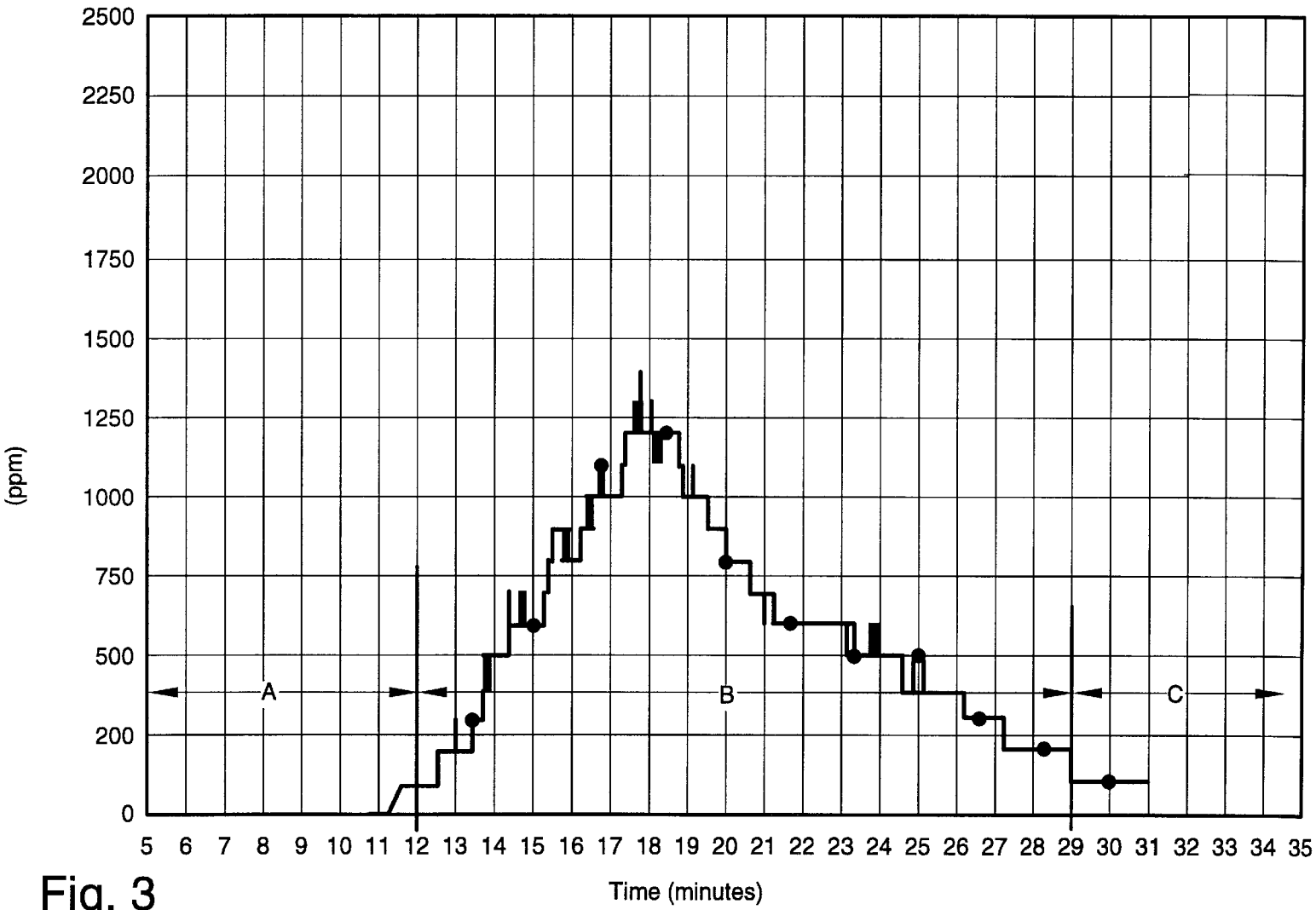
FIG. 3 is a graphic illustration of the gas concentration levels in the oven exhaust during a self-cleaning cycle.

As discussed above, the present invention may be practiced by measuring various gas components which result from the combustion of food in an oven cavity. FIG. 3 illustrates measured concentration of a gas component, such as CO or $CO_2$, over time. Although different foods will provide different absolute levels gas components as measured by the sensor 60, and different time frames will be involved for different amounts of spilled food products, a somewhat bell shaped curve of measured gas concentration will occur during the cleaning process.

In a first time period A, the measured amount of gas will be fairly negligible as the cooking cavity is heated up to the combustion temperature. If the range is a gas range, and if the concentration of CO is being sensed, there may be an initial spike of CO readings during this time, representing the combustion bi-products of the gas being combusted for heating. This initial spike should be ignored by the controller which can be effected by waiting an initial time period, at least as long as time period A, before beginning any gas readings.

During time period B there will be significant readings by the sensor 60 first with each successive reading generally being greater than the prior reading and then, following the peak, with each successive reading generally being less than the prior reading.

During time period C the readings will continue to diminish, however the difference between successive readings will become much smaller. Hence, the slope of the curve will diminish until it reaches a very small number, essentially zero. Applicants have determined that this changing slope of the curve can be used to determine the conclusion of the cleaning process. That is, when the downside slope becomes small, this signifies that the gas component, such as CO or $CO_2$, is no longer being generated, meaning that combustion is essentially complete.

Accurately measuring gas component concentrations resulting from soil combustion in an oven cavity can be difficult to achieve. During the cleaning process in pyrolytic ovens, the combustion of accumulated soils produces various gas components but also moisture, grease-laden air and some amount of particulate matter. Additional moisture is produced in gas ranges as a result of normal combustion. These undesired products—moisture, grease laden air and particulates—can interfere with accurately measuring the gas components also produced from the soil combustion, particularly when using an IR type gas sensor. Moisture has a spectrum adsorption wavelength very close that of CO and $CO_2$ such that an IR sensor can misread the quantity of CO or $CO_2$ present. Moreover, grease contamination on reflective surfaces in an IR sensor can decrease the instrument sensitivity.

Figure 4:
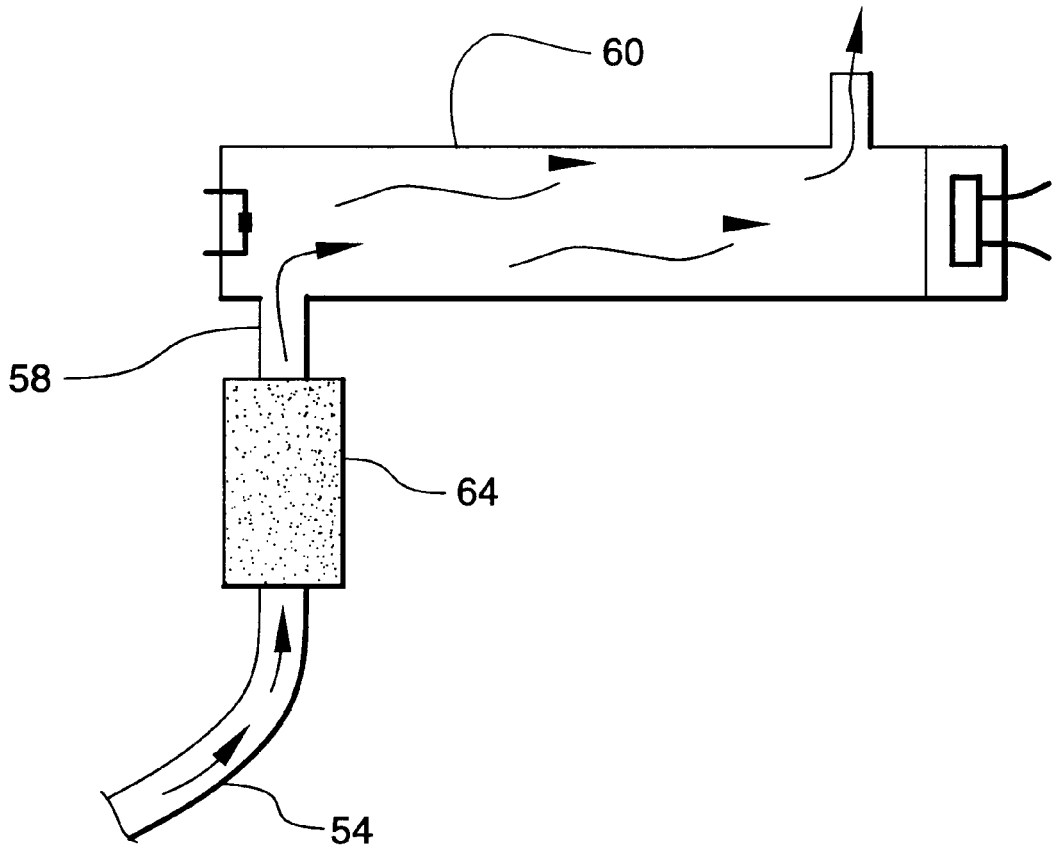
FIG. 4 is an enlarged view of section A from FIG. 2, illustrating the filter and gas sensor.
Figure 5:
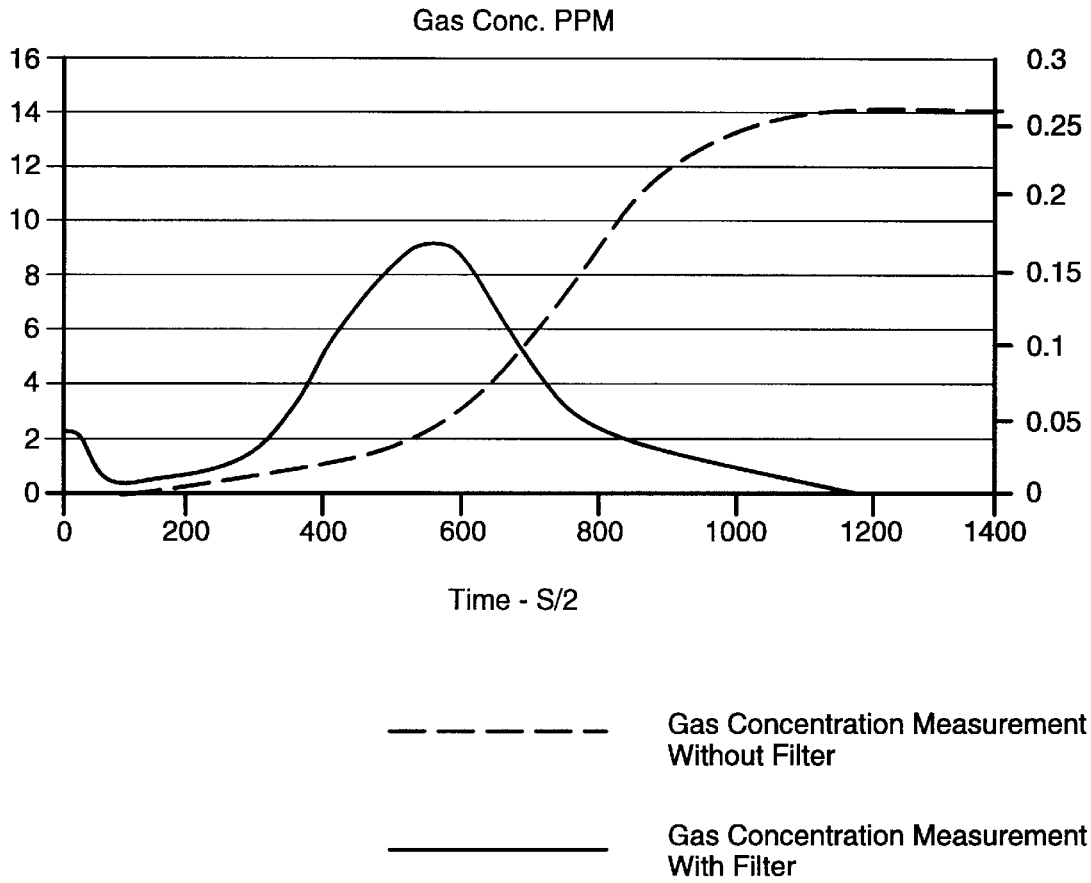
FIG. 5 is a graphical illustration of measured gas component concentration levels in an oven with and without using a carbon filter.

To address this concern regarding undesired products, the present invention includes a filter 64 provided in line with the outlet tube 54, as best shown in FIG. 4. Although different filters could be used, an activated carbon filter is preferred. Activated carbon is a very porous material capable of adsorbing water vapor. As the sample gas flow passes through the charcoal pellets in the filter 64, it is forced to change direction may times causing the water to separate. This redirection also traps the grease and particulate matter before it reaches the gas sensor 60. FIG. 5 illustrates the improved performance that is achieved through the use of a filter 64.

Figure 6:
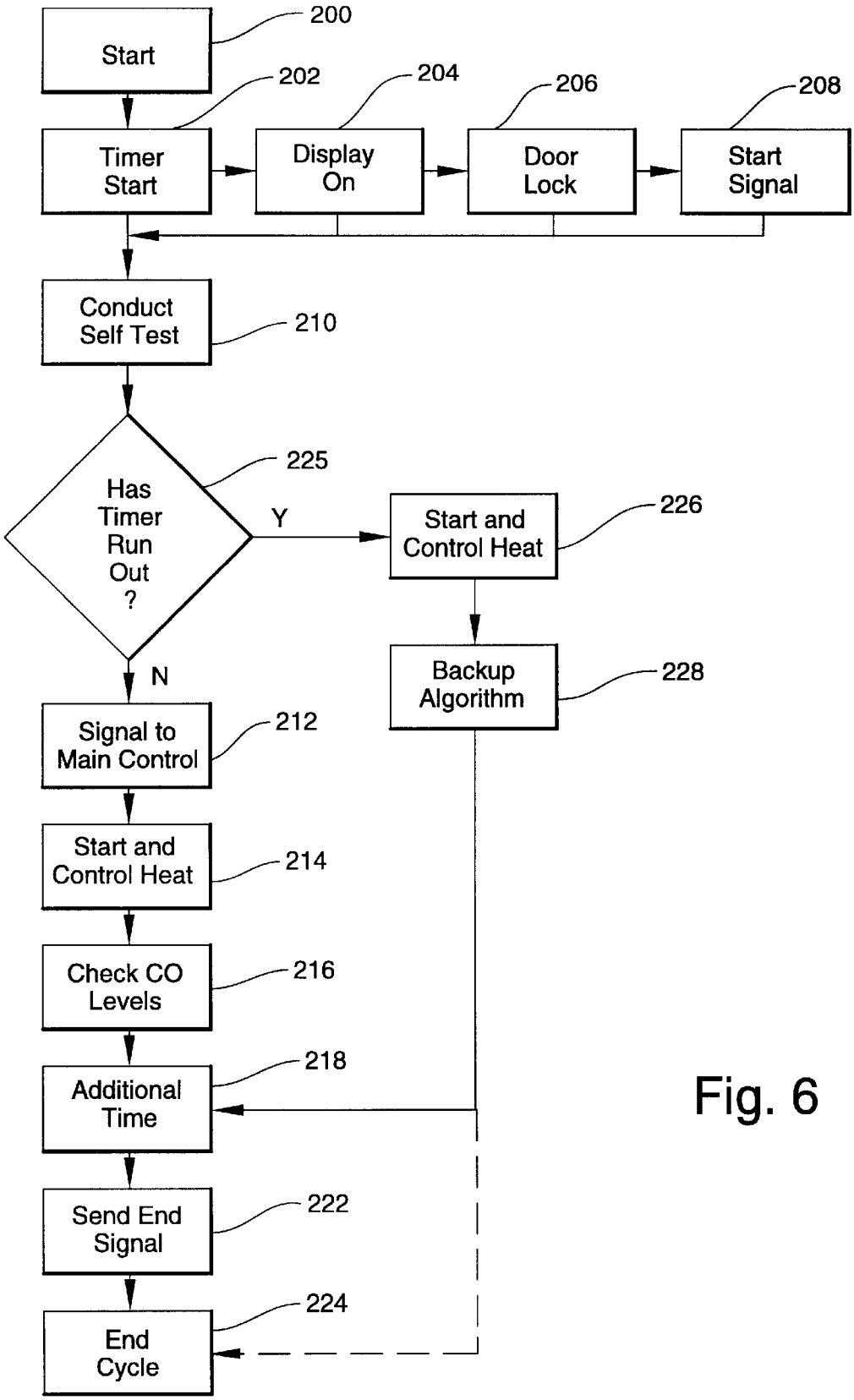
FIG. 6 is a flow chart for describing an example of a cleaning time control operation for the clean cycle in accordance with the principles of the present invention.

Turning now to FIG. 6, when the clean cycle is selected by the user, via mode selection 20C (FIG. 2), the control will start the clean cycle as indicated at step 200. Step 202 designates that a timer is initiated, step 204 designates that a display is turned on to indicate that the clean cycle is in operation, step 206 indicates that the door to the oven is locked and step 208 indicates that a start signal is sent from the main control 36 to the sensor control 62. This could occur as by sending a high voltage (5 volts) on line 66 from the main control 36 to the sensor control 62. Each of the steps 202–208 can occur relatively simultaneously and in any selected order. The display in step 204 could be as simple as a lit lamp, such as an incandescent bulb, a neon bulb or an LED. Alternatively, an electronic display may be provided which initially could be an icon indicating that the cleaning cycle is in progress, and once the time required for the cleaning cycle is determined, a count down timer could be displayed indicating the time remaining for the cleaning cycle.

Step 210 indicates that the sensor control 62 conducts a self check. First, the sensor control 62, upon receiving the start signal on line 66 from the main control 62, will return a signal back to the main control on line 68. Upon conclusion of the successful determination that the sensor is operable, the sensor control will send a signal, to the main control, as indicated in step 212. Both of these steps should occur relatively quickly and before the timer, which is being monitored in step 225, reaches a time indicating a missed signal. If both the high and low signals have been sent to the control 36, control moves to step 214 where one or both heating elements in the oven cavity are energized to raise the temperature in the oven cavity to a cleaning temperature. Also in step 214 the timer will be checked to determine when an initial period, for example one minute, has passed which allows initial start up transients to settle before beginning any readings by the sensor 60. Once the time has passed, control moves to step 216 where CO levels are checked and compared in accordance with the algorithm set forth below with respect to FIG. 7.

Once that algorithm has been completed, control moves to step 218 to wait for an additional predetermined time, such as 45 minutes, following the sensed completion of the cleaning operation. Then control passes to step 222 wherein the sensor control 62 sends a signal, such as a low voltage (such as zero volts), to the main control 36 on line 68 and, as indicated in step 224, the main control 36 terminates the cycle by terminating the input of any heat to the cooking cavity and allows for time for the cooking cavity to cool sufficiently before unlocking the oven door. At this point the signal from the main control 36 on line 66 would return to a low voltage (such as zero volts).

Between steps 210 and 212, at step 225, the main control 36, after passage of a predetermined time period, may recognize that it has not received a first high signal from the sensor control 62, indicating that the sensor control is not operational. If this is the case, control will then pass to step 226 wherein once the initial timer has been satisfied (one minute), heat will begin to be applied to the oven cavity through energization of one or both elements, as described above, by the main control to initiate the self-cleaning operation, and a backup algorithm will begin operation, such as the backup algorithm set forth below with respect to FIG. 9, or alternatively, a predetermined time period may be programmed for operating the heating device for the self-cleaning operation. Once the algorithm is completed or time for the self-cleaning operation has passed, control will pass to step 218 to continue as described above, or directly to step 224 to end the cycle.

If the predetermined time at step 225 has passed and, although there was an initial signal, such as the high voltage, sent by the sensor control 62 indicating that the sensor control was operational, but no second signal, such as a low voltage, indicating that the sensor 60 itself was operational, control will also pass to step 226 to initiate the self-cleaning operation in accordance with the procedures of step 228 and, upon their completion, control will pass to step 224 to end the self-clean cycle as described above.

Figure 7:
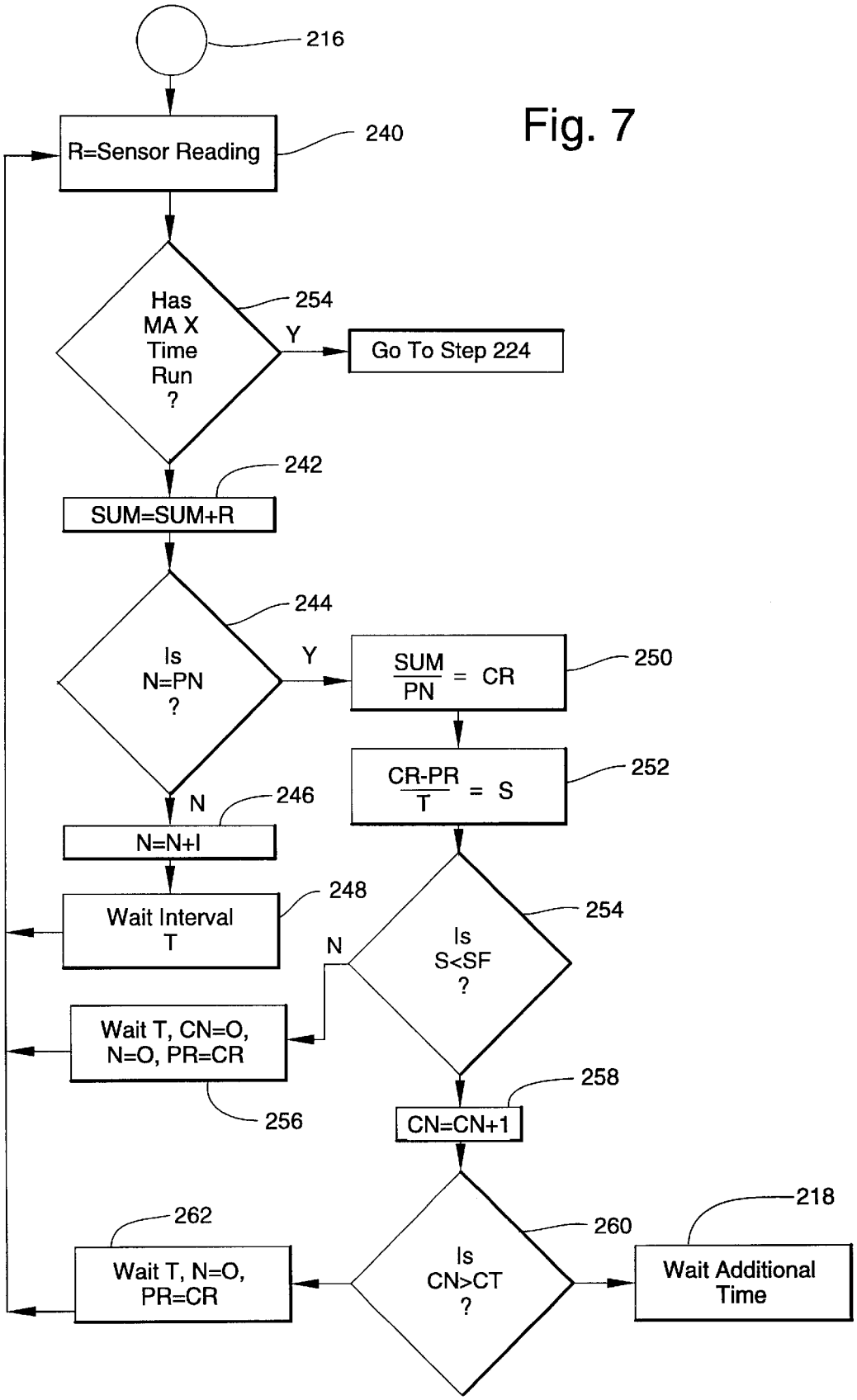
FIG. 7 is a flow chart for describing an example of a gas concentration detection algorithm in accordance with the principles of the present invention.

FIG. 7 illustrates in detail the CO sensing control operation for determining the proper length of time for the self-cleaning step represented as step 216 in FIG. 6. In step 240, the CO sensor 60 is read and the value is stored as variable R. In step 241, the timer is checked to determine whether a maximum time period since the start of the cleaning process in step 200 has passed. If the maximum time has not passed, then control passes to step 242. If the maximum time for a cleaning operation has passed, it could indicate that the sensor has failed during the cleaning cycle, even though it was initially indicated to be operational, and control will be passed immediately to step 224 to end the cycle. Thus, the maximum time to be checked at step 241 would be a maximum worst case cleaning period.

In step 242 the variable SUM is incremented by the value of R. In step 244 there is a check to determine whether the number of readings is equal to some predetermined number of readings. If not, control passes to step 246 where the number of readings is incremented by one and then control passes to step 248 where the control waits a predetermnined interval of time before passing control back to step 240 to take an additional reading. Once the number of readings has reached the predetermined number in step 244, control passes to step 250 where the sum of the readings is divided by the predetermined number to achieve an average reading which is stored in variable CR as the current reading. In step 252 the prior reading PR is subtracted from the current reading CR and that value is divided by a time interval T since the prior reading and that value is stored as variable S which comprises the slope of the line between the prior reading and the current reading. In step 254, the slope S is checked to determine whether it is less than a predetermined final slope SF. If the slope S is not yet below the predetermined final slope, then control is passed to step 256 where the prior reading PR is replaced with the current reading CR, the number of readings N is reset to zero and the counter CN is reset to zero. After a time period T has passed, control passes back to step 240 to repeat the above process.

If the slope S is determined to be less than the final slope in step 254, then control passes to step 258 where the counter is incremented by one and then control passes to step 260 where it is determined whether the counter CN exceeds a predetermined total count CT. If the counter has not yet exceeded the total count, then control is passed to step 262 where the prior reading PR is replaced by the current reading CR, the number of readings N is reset to zero and again the time T is passed before control returns to step 240 to repeat the above process. Once the loop passing through step 258 repeats a sufficient number of times without control branching to step 256, the counter CN will exceed the total count CT in step 260 signifying that the slope has been maintained below the predetermined final slope over a sufficient time period and control with then pass to step 218 for the additional time to pass, as indicated above in connection with the flow chart of FIG. 7 and the method will proceed in accordance with the previous description following step 218.

If the range 10 is a gas range, step 254 will need to be modified slightly due to the fact that the gas burners in the oven cavity will be operated periodically to maintain the cavity at the proper cleaning temperature. As this occurs, there will be a temporary increase in the CO levels which are not indicative of spilled food combusting, as so should be ignored. Therefore, a further counter K could be employed, and only if the slope is greater than the minimum for a consecutive number of readings would control be passed to step 256 to reset counter CN. If K has not reached the minimum number, control would pass to step 258, even though the slope is (perhaps temporarily) higher than SF. In such a situation, clearly, the maximum permitted value for K would be a number smaller than CT.

Figure 8:
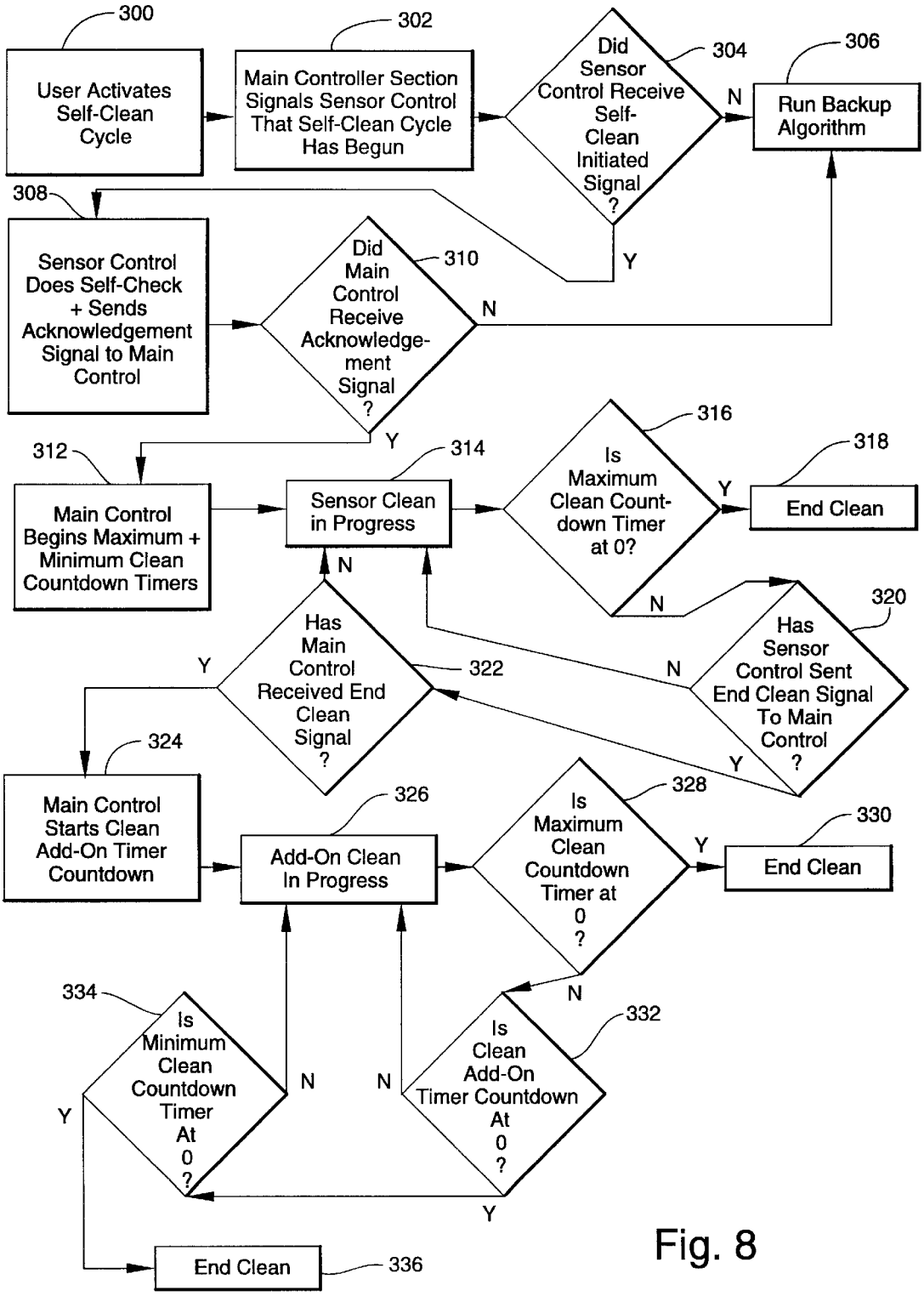
FIG. 8 is a flow chart for describing an example of a backup algorithm to be used in the event of sensor failure or when no sensor is used, in accordance with the principles of the present invention.

FIG. 8 illustrates, in somewhat greater detail than FIG. 6, the cleaning time control operation for a self cleaning cycle in accordance with the principles of the present invention. In step 300 the user activates the self-clean cycle, this can be done by operation of the control knob 20 on the console 59. In step 302 the main controller section 36 sends a signal to the sensor control 62 indicating that the self-clean cycle has begun. In step 304 an inquiry is made to determine whether the sensor control 62 has received the self-clean initiated signal from the main controller section 36. If the signal has not been received, then control moves to step 306 where a backup algorithm is run to operate the self-clean procedure, such as described with respect to step 228 described above.

If the sensor control in step 304 did receive the signal, then control is passed to step 308 where the sensor control 62 performs a self-check and sends an acknowledgment signal back to the main control 36. In step 310 an inquiry is made to determine whether the main control received the acknowledgment signal. If no acknowledgment signal was received, then control passes to step 306 to run the backup algorithm as described above.

If the main control in step 310 did receive acknowledgment, then control is passed to step 312 where the main control begins the maximum and minimum clean count down timers. Control then passes to step 314 where the cleaning is in progress and is detected by the sensor. Periodically an inquiry is made as in step 316 to determine whether the maximum clean count down timer has reached zero. If it has, then control passes to step 318 and the clean cycle is ended. If the count down timer has not reached zero in step 316, then control is passed to step 320 where it is determined whether the sensor control has sent an end clean signal to the main control. If it has not, then control passes back to step 314 to continue the cleaning and sensing the cleaning step.

Once it has been determined in step 320 that the sensor control has sent the end clean signal to the main control, then control passes to step 322 where an inquiry is made to determine whether the main control has received the end clean signal. If it has not, control passes back to step 314 as to continue the cleaning process as described above. Once it has been determined in step 322 that the main control has received the end clean signal, then control passes to step 324 where the main control starts a clean add-on timer count down. This timer is utilized to provide an additional amount of cleaning time even beyond the detection of the end of the cleaning cycle to insure that all materials are combusted and the oven is cleaned.

Control then passes to step 326 where the add-on cleaning process is in progress. Periodically an inquiry is made in step 328 as to whether the maximum clean count down timer, which was initiated in step 312, has reached zero. If it has, then control passes to step 330 to end the cleaning cycle. If the maximum clean count down timer has not reached zero in step 328, then control passes to step 332 where an inquiry is made to determine whether the clean add on timer has reached zero. If it has not, then control passes back to step 326 to continue the add on cleaning process.

Once it has been determined in step 332 that the cleaning add-on timer has reached zero, control is passed to step 334 to inquire whether the minimum clean count down timer has reached zero. If it has not, then control is passed back to step 326 to continue with the add-on cleaning process. This will insure that at least a minimum amount of time for the self-clean process occurs. If the result of the inquiry in step 334 is affirmative, that the minimum clean count down timer has reached zero, then control is passed to step 336 to end the self-clean cycle.

As mentioned above, the present invention may be implemented using a gas or electric range. If the invention is practiced using CO measurements, it can be appreciated by one skilled in the art that for an electric range, the heating system does not contribute to the CO level in the cavity during cleaning. During the cleaning process, the CO level rises as combustion of spill material begins and falls off as the combustion is completed. The same results occur in a gas range, however with varying absolute levels of CO due to the gas burner contribution to the CO level. Gas ranges will show a characteristic rise of CO level at initiation of burner combustion (as the heating source for the cavity) as is seen during self-clean combustion. However, most gas burner ovens are designed such that in the cavity, this peak is reached well before the characteristic self-clean increase begins, that is, the cavity must receive significant energy from the burner before combustion of spilled material begins.

As indicated above with respect to FIG. 6 and FIG. 8, in step 228 or 306, respectively, a backup algorithm may need to be employed in the event that the sensor control 62 or sensor 60 itself are not functional or not sending appropriate signals. In such case, a predetermined time may be selected for operation of the self-cleaning cycle in which only a timer need be employed. Alternatively, and still to gain some benefit from reduced energy usage based upon actual need for properly cleaning, an alternative algorithm which does not require the use of a gas sensor may be utilized.

Figure 9:
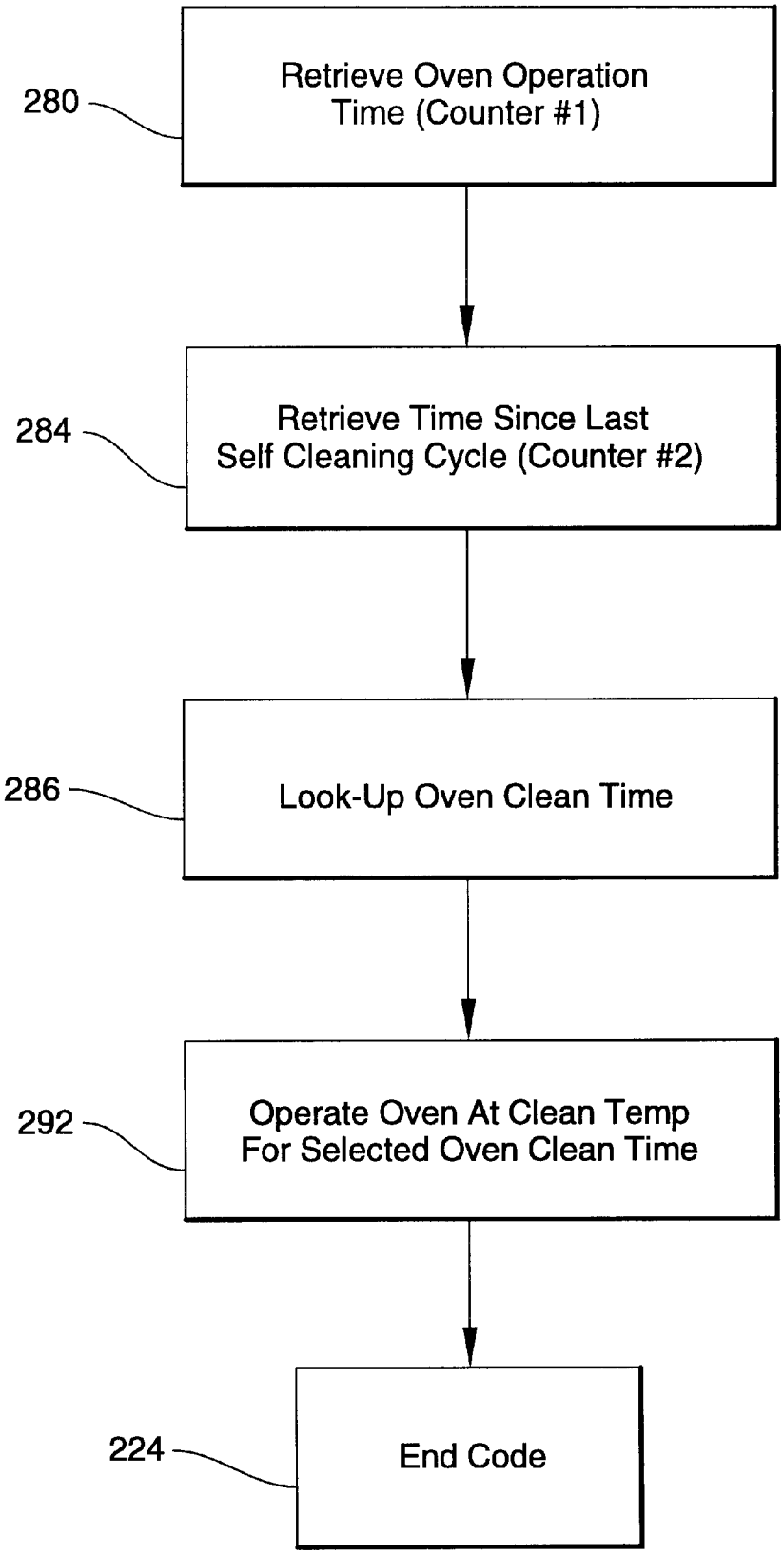
FIG. 9 is a flow chart describing a cleaning time control operation for the clean cycle in accordance with the principles of the present invention.

FIG. 9 illustrates an alternative or back-up algorithm that may be used to control the time for a self-cleaning cycle. In such an algorithm, a first counter 72 (FIG. 2) counts or measures the actual run times for the broil and bake operations since the last self clean operation. Alternatively, the counter may count the number of bake cycles and broil cycles which have occurred since the last clean cycle. The counter 72 may be associated with the control 36 for measuring the time the oven has been operated since the previous self clean cycle or the counter 72 may be associated with the control selection knobs 20, 22 to count the number of times and/or duration of the bake or broil modes since the previous self cleaning cycle. A second counter or timer 74 is used to determine the length of time, in days or weeks, since the last cleaning cycle.

Once the backup algorithm is selected at step 228, control passes to step 280 where the total oven operation time since the last self cleaning cycle is retrieved from the first counter 72. The total oven operation time since the last self cleaning cycle may be expressed in minutes or hours. Alternatively, the number of baking cycles, or total baking times, may be retrieved and the number of broiling cycles, or total broiling times, may be retrieved. In step 284, the total time since the last clean cycle is retrieved from the second counter 74. The total time since the last self cleaning cycle may be expressed in days or weeks. The control 36 then references a lookup table, as shown in step 286, to determine the oven clean time which corresponds to the measured oven operation duration and total time since the last oven cleaning. In step 292 a timer is initiated to operate the cleaning cycle for the selected oven clean time and, once the selected time has passed, control passes to step 224 to end the cycle. At the end of such self cleaning cycle, the oven operation duration counter 72 and the total time since last cleaning cycle counter 74 would be reset to zero.

Figure 10:
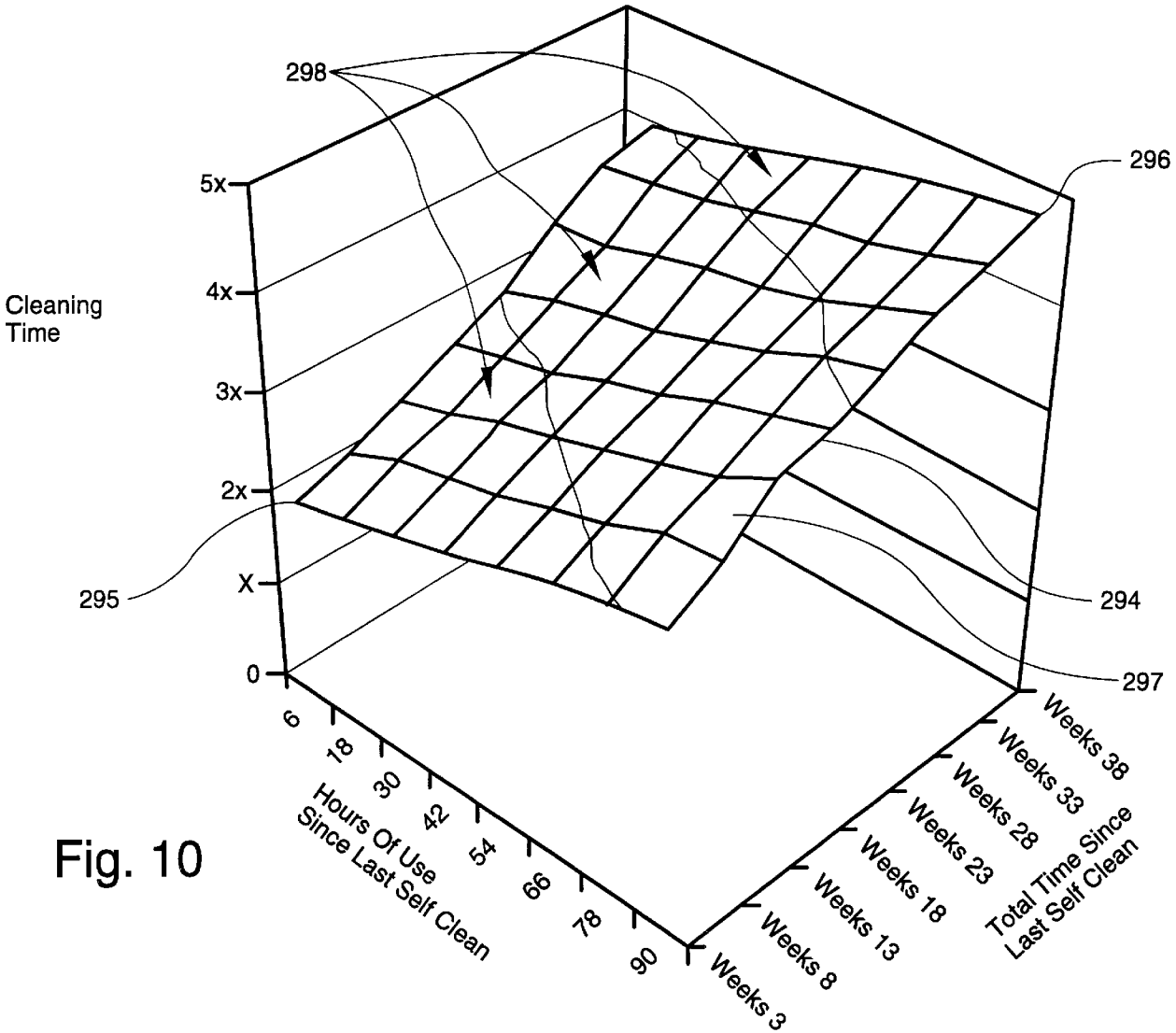
FIG. 10 is a graphic illustration of bake and broil cycles vs. weeks since last self-clean cycle vs. time for self-clean cycle.

FIG. 10 graphically illustrates values that could be placed into a look up table which is checked in step 286 as described above. This graph extends in three dimensions and along two perpendicular horizontal axes lists the hours of total use since the last cleaning cycle and the number of weeks representing a period of time since the last cleaning cycle has occurred. The vertical axis represents a period of time for the self-clean cycle which are values that would be experimentally determined for each particular type of oven cavity. Shown suspended in the graph is a surface 294 that extends horizontally but also is angled vertically starting from a low point at the leftmost corner 295, representing the lowest number of hours of use and fewest number of weeks since the last cleaning and a high point at the rightmost corner 296 representing the highest number of hours of use and greatest number of weeks since the last cleaning. This surface 294 can be divided into grid pieces 297 for particular numerical values being the average of the position of each grid piece, or it can be divided into large segments 298, such as the three illustrated, representing a quantity of time x or a multiple of that quantity. Thus, the control can either provide finally divided time differences for the cleaning cycle based upon the value of each grid piece 297 or could provide fewer different cycle times based upon the larger segments 299. These values could be stored in a look-up table for the control to check in step 290.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An oven capable of being operated in a self-cleaning cycle, comprising:

a cooking chamber;

a heating device in thermal communication with said cooking chamber;

an exhaust flue extending from said cooking chamber and leading to atmosphere;

a gas sensor being configured to have a signal output indicative of a measured concentration of a gas component during said self-cleaning cycle;

a countdown timer to count down the remaining cleaning cycle time;

a display device to provide the user with a visual display of information related to the self cleaning cycle; and a heat control device operably coupled to the gas sensor, countdown timer, and display device to receive successive gas concentration signals from said gas sensor, set the countdown timer based on the gas concentration signals, display the remaining cycle time on the display device, and initiate termination of said self-cleaning cycle in response to the measured gas concentrations.

2. An oven according to claim 1, wherein the heat control device is operable to determine a rate of change between said sucessive signals and once said determined rate of change is maintained below a minimum preset rate of change value for a predetermined length of time to initiate termination of said self-cleaning cycle.

3. An oven according to claim 1, wherein said heating device is an electrical resistance element.

4. An oven according to claim 1, wherein said heating device is a gas burner.

5. An oven according to claim 1, wherein the gas component is carbon monoxide (CO) or carbon dioxide ($CO_2$).

6. An oven according to claim 1, further comprising:

an outlet tube having an inlet end connected with said exhaust flue and an outlet end, said gas sensor located at said outlet end of said outlet tube such that a sample gas flow is provided to said gas sensor through said outlet tube;

an activated carbon filter device located in said outlet tube for removing moisture and particulate matter from the sample gas flow supplied to said gas sensor.

7. The oven according to claim 1, wherein the heat control device is operable to determine the duration of the self-cleaning cycle based on the time rate of change of the concentration of the component.

8. The oven according to claim 7, wherein the component is at least one of carbon monoxide or carbon dioxide.

9. The oven according to claim 1, wherein the gas sensor output signal is a stop cycle signal indicative that the self-clean cycle is complete.

10. The oven according to claim 9, wherein the gas sensor further comprises a gas sensor controller operably coupled to the heat control device to receive concentration signals indicative of the concentration of a component of the exhaust gases, determines the completion of the self-clean cycle therefrom, and then sends the stop cycle signal to the heat control device.

11. The oven according to claim 10, wherein the gas sensor controller is operable to determine a time rate of change of successive concentration signals and once the determined rate of change is maintained below a minimum preset time rate of change value to send the stop cycle signal.

12. The oven according to claim 1, and further comprising an outlet tube in which the gas sensor is located, the outlet tube having an inlet end connected to the exhaust flue and establishing fluid communication therewith such that at least a portion of the exhaust gases flow into the outlet tube and to the gas sensor.

13. The oven according to claim 12, and further comprising a filter located within the outlet tube closer to the inlet end than the gas sensor.

14. The oven according to claim 13, wherein the filter is an activated carbon filter.

15. The oven according to claim 12, wherein at least a portion of the outlet tube is angled upwardly.

16. The oven according to claim 12, wherein the outlet tube has an outlet end and the gas sensor is located adjacent to the outlet end.

17. The oven according to claim 1, wherein the gas sensor is an infrared sensor.

18. An oven capable of being operated in a self-cleaning cycle, comprising:

a cooking chamber;

a heating device located in said cooking chamber;

an exhaust flue extending from said cooking chamber and leading to atmosphere;

an outlet tube having an inlet end connected with the exhaust flue and leading to an outlet communication with atmosphere;

a heat actuated valve for preventing a flow of gas from passing through the outlet tube during non self-cleaning oven cycles positioned near the inlet such that said inlet is closed by said heat actuated valve at all temperatures below a predetermined temperature;

a gas sensor located in said outlet tube for measuring gas concentration levels during said self cleaning cycle.

19. An oven according to claim 18, wherein said outlet tube comprises a tube having an inlet end and an outlet end and further having a portion having an upward angle.

20. An oven according to claim 19, wherein said outlet end of said outlet tube is located in a console of said oven, remote from cooking chamber.

21. An oven according to claim 18, wherein said gas sensor is located adjacent said outlet of said outlet tube.

22. An oven according to claim 18, wherein said gas sensor is an infrared sensor.

23. An oven according to claim 18, further comprising:

an activated carbon filter device located in said outlet tube for removing moisture and particulate matter from the sample gas flow supplied to said gas sensor.

24. An oven according to claim 18, wherein said heat actuated valve comprises a bimetal valve.

25. An oven according to claim 18, further comprising:

input controls for selecting baking, broiling or self cleaning operations in said cooking chamber;

a heat control device being operable to initiate said self-cleaning cycle upon receipt of input from a user, including operation of said heating device for providing heat to said cooking chamber to combust food items in said chamber and to initiate termination of said self-cleaning cycle upon a completion of a cleaning operation, said completion occurring at a time that can be determined in advance by said control device; and a display device controlled by said heat control device to provide a first display to a user indicating that a self-clean cycle is in progress and a second display provided before an end of said self-cleaning cycle to indicate to a user a remaining amount of time required said self-clean cycle.

26. An oven according to claim 25, wherein said heat control device communicates with said gas sensor and receives successive gas concentration signals from said gas sensor and wherein said heat control device determines a rate of change between said successive signals and initiate termination of said self-cleaning cycle once said determined rate of change is maintained below a minimum preset rate of change value for a predetermined length of time.

27. An oven according to claim 25, wherein said heat control device includes a counter for counting the oven operation time since a last self-cleaning operation, and is operable to initiate termination of said self-cleaning cycle after passage of an amount of time based upon the amount of oven operation time since a last self-cleaning operation.

28. A method for controlling a self-cleaning oven having: a cooking chamber, a heating device for supplying heat into said cooking chamber, an exhaust outlet from said cooking chamber leading to atmosphere, a gas sensor communicating with said exhaust outlet for measuring a concentration of gas and having a signal output indicative of said measured concentration of gas during said self-cleaning cycle, and a heat control device for controlling and heating device, comprising:

accepting an input at said heat control device to begin a self-cleaning operation;

determining whether said gas sensor is operable;

if said gas sensor is determined to be operable, operating said heating device in accordance with a first algorithm based upon measured gas levels provided by said gas sensor; and if said gas sensor is determined to be inoperable, operating and heating device in accordance with an algorithm not based upon measured levels.

29. A method according to claim 28, wherein said first algorithm comprises measuring successive CO levels with said gas sensor at periodic times, determining a rate of change of successive CO levels, and initiating a termination of said self-cleaning cycle once said rate of change of successive CO levels has reached at predetermined level for a predetermined length of time.

30. A method according to claim 28, wherein said second algorithm comprises maintaining a count of the duration of oven operation since a last self-cleaning cycle and conirolling said heating device to heat said oven cavity for a time period based upon the amount of oven operation time since a last self-cleaning operation.

* * * * *